US010154766B2

(12) United States Patent
Bensing et al.

(10) Patent No.: US 10,154,766 B2
(45) Date of Patent: Dec. 18, 2018

(54) CLEANING DEVICE

(71) Applicant: Alfred Kärcher GmbH & Co. KG, Winnenden (DE)

(72) Inventors: Felix Bensing, Stuttgart (DE); Thomas Robieu, Leutenbach (DE); Florian Ebert, Kernen (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 318 days.

(21) Appl. No.: 15/078,706

(22) Filed: Mar. 23, 2016

(65) Prior Publication Data

US 2016/0198917 A1 Jul. 14, 2016

Related U.S. Application Data

(63) Continuation of application No. PCT/EP2013/069794, filed on Sep. 24, 2013.

(51) Int. Cl.

| | |
|---|---|
| ***A47L 7/00*** | (2006.01) |
| ***A47L 11/40*** | (2006.01) |
| ***A47L 9/00*** | (2006.01) |

(52) U.S. Cl.

CPC ..... *A47L 7/0023* (2013.01); *A47L 9/0081* (2013.01); *A47L 11/4016* (2013.01)

(58) Field of Classification Search

CPC .. A47L 7/0023; A47L 11/4016; A47L 9/0081; A47L 7/00

USPC ..... 15/326

See application file for complete search history.

(56) References Cited

U.S. PATENT DOCUMENTS

| | | | |
|---|---|---|---|
| 4,617,034 | A | 10/1986 | Ikezaki et al. |
| 4,970,753 | A | 11/1990 | Herron, Jr. |
| 2006/0254022 | A1 | 11/2006 | Oh et al. |

FOREIGN PATENT DOCUMENTS

| | | |
|---|---|---|
| CN | 201026174 | 2/2008 |
| CN | 202426454 | 9/2012 |
| DE | 38 15 320 | 11/1989 |
| EP | 1 969 984 | 9/2008 |
| JP | S42-12280 | 7/1967 |
| JP | 2004-279779 | 10/2004 |

*Primary Examiner* — David Redding

(74) *Attorney, Agent, or Firm* — Womble Bond Dickinson (US) LLP

(57) ABSTRACT

A cleaning device is proposed which includes a base, an air-conduit device which is arranged on the base, and at least one chamber with a wall which delimits a cavity, an inlet device for a fluid stream and an outlet device being arranged on the wall, and at least one fluid channel running in the cavity between the inlet device and the outlet device, wherein at least one partition wall is arranged in the cavity, said partition producing an acoustic shielding effect between the inlet device and the outlet device.

33 Claims, 6 Drawing Sheets

CLEANING DEVICE

This application is a continuation of international application number PCT/EP2013/069794 filed on Sep. 24, 2013, which is incorporated herein by reference in its entirety and for all purposes.

BACKGROUND OF THE INVENTION

The invention relates to a cleaning device comprising a base, an air-conduit device which is arranged on the base, and at least one chamber with a wall which delimits a cavity, an inlet device for a fluid stream and an outlet device being arranged on the wall, and at least one fluid channel running in the cavity between the inlet device and the outlet device.

A noise reduction device which has a noise reduction plate is known from JP 2004279779.

A cleaning device which has a noise suppression device is known from U.S. Pat. No. 4,617,034.

A vacuum cleaner which has means for diffusing air is known from EP 1 726 244 A2.

A vacuum cleaner is known from JP 4-218127.

SUMMARY OF THE INVENTION

In accordance with the present invention, a cleaning device is constructed in a constructionally favorable way, while providing effective sound reduction.

In accordance with an embodiment of the invention, at least one partition wall is arranged in the cavity, which partition produces an acoustic shielding effect between the inlet device and the outlet device.

The at least one partition wall in the cavity ensures a fluid conduit within the at least one chamber between the inlet device and the outlet device. It is, in particular, constructed here such that the pressure loss of the flow within the cavity is minimized.

The chamber furthermore produces an acoustic shielding effect (shading effect) between the inlet device and the outlet device, such that a sound level reduction occurs in the at least one chamber.

The at least one partition wall is, in particular, configured such that sound is reflected within the cavity. The sound is reflected here, in particular, on the wall and the at least one partition wall. This means that the sound intensity which is coupled into the at least one chamber via the inlet device is reduced in the chamber, and the sound intensity which can escape from the at least one chamber via the outlet device is reduced with respect to the intensity of the entering sound.

It is favorable if the at least one chamber is arranged on the base and forms a retaining wall for one or more components of the cleaning devices and/or forms a housing wall of a housing of the cleaning device, which housing wall delimits a housing interior, and/or forms the base at least in part. The chamber, by means of which an effective sound reduction (noise reduction) can be achieved, can then assume further functions on the cleaning device. Thus a cleaning device having a compact design with minimized sound emission can be realized.

For example, the at least one chamber forms a rear wall or front wall or side wall of a housing of the cleaning device. The chamber, which is constructed as a chamber silencer, can thus be integrated in a housing of the cleaning device in a simple and advantageous manner.

In particular, a fan device is arranged in a housing interior of the housing. The fan device provides, for example, exhaust air which is conveyed through the chamber in order to ensure a reduction in sound.

In one embodiment, it is provided that the at least one chamber is positioned removably on the base, this chamber being fluidically connected to the air-conduit device via the inlet device in the case of at least one chamber being positioned on the base. Thus the at least one chamber can fulfill one or a plurality of further functions in addition to fluid conveyance and silencing in the cleaning device, such as for example forming a removable housing wall. The removability enables access to a housing interior.

In one embodiment, the at least one chamber has a depth which is smaller than a width and/or a height of the at least one chamber, the width in particular being at least five times greater and, for example, at least ten times greater than the depth and/or the height being at least five times greater and, for example, at least ten times greater than the depth. Thus an effective sound reduction can be achieved.

In one embodiment, the wall comprises a first wall and an opposing second wall which are spaced apart in a depth direction, side walls being arranged between the first wall and the second wall, and in particular a floor-side wall, a ceiling-side wall and opposing lateral side walls being arranged between the first wall and the second wall. A chamber with a cavity can thus easily be realized.

In one embodiment, the inlet device is arranged on the first wall. Thus the chamber can easily be constructed for example as a rear wall of a housing of the cleaning device. The opposing second wall has a reflection effect for sound waves coupled in via the inlet device.

For the same reason, it is advantageous if an outer side of the second wall forms an outer side of the cleaning device. This allows the number of components of the cleaning device to be kept low, while providing effective sound reduction.

It is then favorable if the outlet device is arranged on the second wall or on a side wall such as for example a floor-side wall. A compact design thus results.

It is exceptionally advantageous if the outlet device is arranged in relation to the direction of gravity below the inlet device when the cleaning device is set up on a support in an operating mode. A relatively long flow path for a fluid flow within the cavity of the at least one chamber can thus be provided, while ensuring effective silencing in the chamber. Furthermore fluid can flow off (and in particular liquid can discharge), even when a fan of a fan device is not activated.

For the same reason, it is favorable if the outlet device is arranged on a floor-side wall which, of the side walls of the at least one chamber, is nearest to the support. A long flow path with effective silencing thus results.

It is exceptionally advantageous if the at least one chamber is an independent unit which can be fixed or is fixed as a whole on the base. The chamber can then be removed as a whole and can thus form, for example, the wall of a housing.

It is favorable if at least a first fluid channel and a second fluid channel are provided, which run from an inlet opening of the inlet device. An air-liquid separation in the at least one chamber can thus, for example, also be realized, while providing effective sound reduction.

Advantageously, the first fluid channel and the second fluid channel at the inlet opening lead away from one another in order to produce an effective separation.

In order to be able to discharge, in particular, liquid such as water, it is favorable if the second fluid channel leads downward in relation to the direction of gravity when the cleaning device is set up in an operating mode on a support. A "phase separation" can thus easily be achieved.

In particular, the second fluid channel is delimited by a floor-side wall of the at least one chamber. Liquid can thus be easily discharged.

It is furthermore favorable if the first fluid channel is led away from the inlet opening upward in relation to the direction of gravity. A long flow path with effective sound reduction can thus be achieved.

In particular, the first fluid channel is delimited by a ceiling-side wall of the at least one chamber. Thus a simple constructional design results, while providing effective fluid conduction and effective sound reduction.

It is exceptionally advantageous if a liquid outlet device is arranged on the at least one chamber. Liquid can thus be separated and isolated, and discharged.

In particular, at least one channel for discharging liquid is associated with the at least one chamber.

Advantageously, the at least one partition wall forms a wall for forming the at least one fluid channel. The partition wall forms a part of a silencer device and ensures a fluid conveying. An effective fluid conveying and, in particular, air conveying with simultaneous effective sound reduction can be achieved by means of the partition wall, in a constructionally simple construction.

In one embodiment, the partition wall has a self-connected closed course, and runs in particular between the first wall and the second wall of the wall. An effective flow conveyance thus results.

It is exceptionally advantageous if an inlet opening of the inlet device is arranged between the partition wall and a side wall of the at least one chamber. A sound reflection on the partition wall and a side wall of the at least one chamber can thus be achieved as soon as sound waves enter the chamber, or an effective reflection of sound waves which arise at the inlet opening can be achieved. There is also a reflection effect upon entry into the at least one chamber on a (rear) wall opposite the inflow device.

It is exceptionally advantageous if the partition wall has an indentation, an inlet opening of the inlet device being arranged at least in part in an indentation space delimited by the indentation. A reflection region is provided by the indentation, by means of which sound waves can be reflected. Sound waves are reflected in the region of the inlet opening, in order to achieve an effective sound reduction.

It is favorable if, starting from the inlet opening, in a first region a fluid channel has a hydraulic channel cross section which narrows, in a second region the fluid channel causes a flow deflection of at least approximately 90°, and in a third region the fluid channel causes a further flow deflection of at least approximately 90°. Thus a cross section increase at the inlet opening can initially be achieved, in order to produce an effective silencing. An effective flow conveyance with a long flow path is achieved by means of the deflections. An effective silencing can, in turn, be achieved by means of a long flow path.

It is favorable if the partition has a curved course in the first region and/or second region and/or third region and/or at a transition between the first region and the second region and/or at a transition between the second region and the third region. An effective flow conveyance can thus be achieved.

Furthermore, a large partition surface is provided for the acoustic shielding effect, and a large surface for silencing is also provided.

It can be provided that the fluid channel has a bulge in the third region. An additional sound reflection and thus shielding (shadowing) effect can be realized by means of the bulge which is, in particular, provided in a region in which a relatively large flow cross section is available.

In one embodiment, the inlet device is coupled to an exhaust air-conduit device of a fan device and/or to a cold air-conduit device. Exhaust air of a suction stream is, for example, conducted through the at least one chamber, in order to release the exhaust air into the environment and thereby achieve an effective sound reduction.

In particular, the outlet device is arranged on an outer side of the cleaning device, in order to release exhaust air accordingly into the exterior space.

It is favorable if a porous device for reducing turbulence is arranged on the outlet device. Thus a further sound reduction is achieved.

The cleaning device is, in particular, constructed as a spray extraction device or suction device, and in particular, as a wet-dry vacuum cleaner.

The following description of preferred embodiments provides a more detailed explanation of the invention, in conjunction with the drawings.

DETAILED DESCRIPTION OF THE INVENTION

Figure 1:
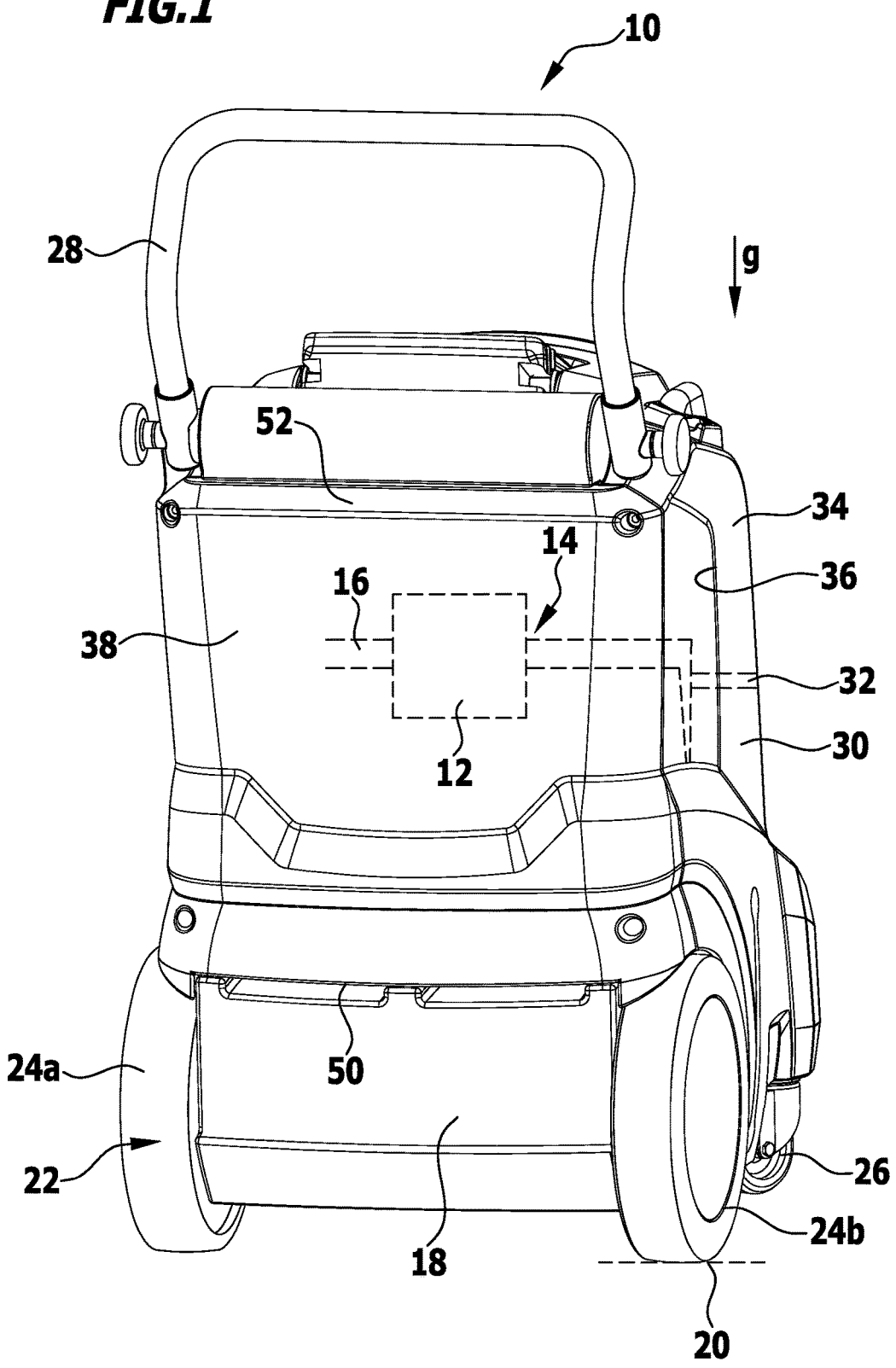
FIG. 1 is a schematic view of an embodiment of a cleaning device with top view of an embodiment of a chamber with silencing properties.

An embodiment of a cleaning device which is shown in FIG. 1 and is indicated therein by 10 is, for example, a spray extraction device or suction device such as a wet-dry vacuum cleaner. The cleaning device 10 comprises a fan device 12, by means of which a vacuum air stream (suction stream) can be produced. In particular, a suction nozzle can be acted upon by suction current by means of a corresponding air-conduit device, in order to achieve a suction effect.

The air-conduit device 14 furthermore comprises an exhaust air-conduit device 16, by means of which exhaust air of the fan device 12 is conveyed. The exhaust air of the exhaust air-conduit device 16 is suction air which has been cleaned, in particular, by a filter device.

The cleaning device 10 has a base 18, by means of which the cleaning device 10 is placeable on a support 20.

In the embodiment shown in FIG. 1, the cleaning device 10 is mobile. A rear wheel device 22 with a left rear wheel **24*a* and a right rear wheel 24*b* is arranged on the base 18. A front wheel device 26 is furthermore arranged on the base 18**. In one embodiment, this comprises one or a plurality of castors.

A handle unit 28 is arranged on the base, by means of which, in particular, an operator can push or pull the cleaning device 10.

The fan device 12 is positioned on the base 18. Here, it can be mounted directly on the base 18 or mounted on a device which, in turn, is mounted directly on the base 18.

A collecting tank 30 which is, in particular, a dirt collecting tank, is furthermore arranged on the base 18. Dirt is sucked into said tank; the suction stream flows through the collecting tank 30. A filter device 32 is associated with the collecting tank 30.

The cleaning device 10 has a housing 34. The housing 34 surrounds a housing interior 36, in which components of the cleaning device 10 are arranged securely. In particular, the fan device 12 and the air-conduit device 14 are arranged in the housing interior 36.

The base 18 is also part of the housing 34 and, in particular, forms a housing base for the housing 34.

Figure 2:
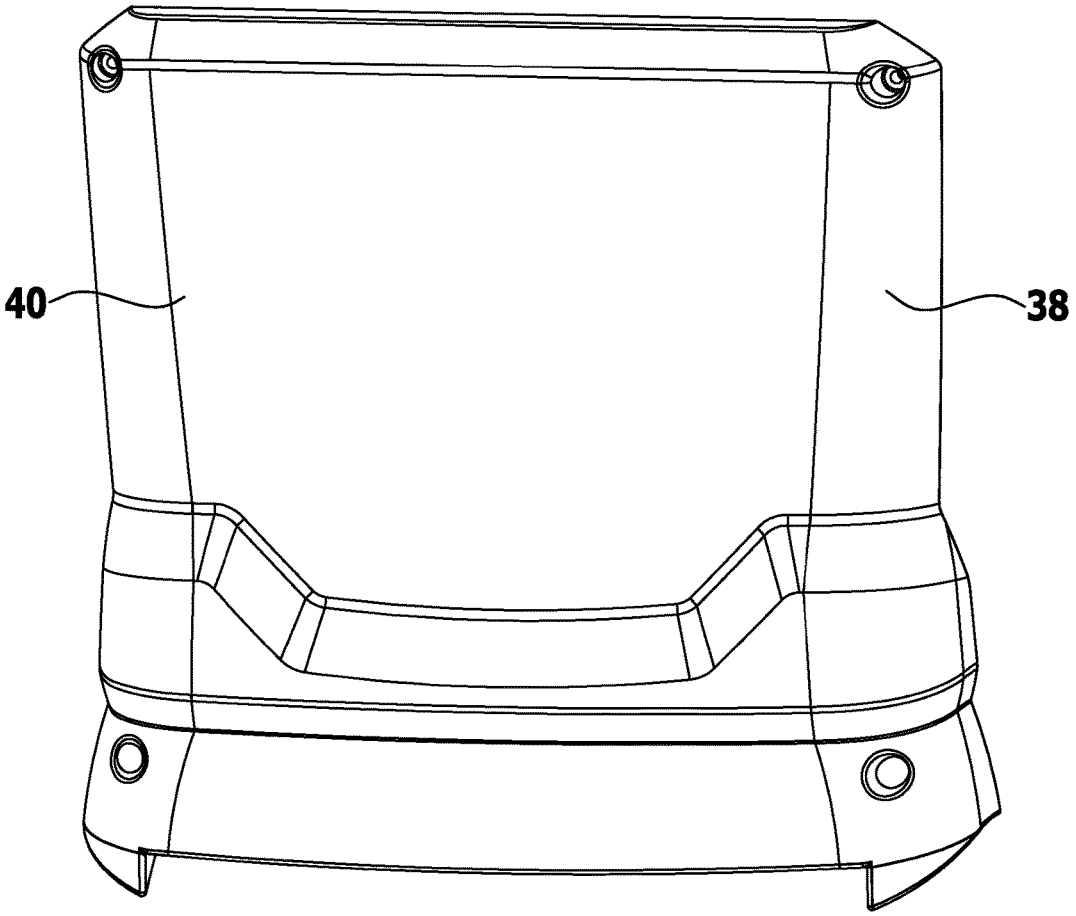
FIG. 2 is a top view of the chamber according to FIG. 1, detached from the cleaning machine.
Figure 3:
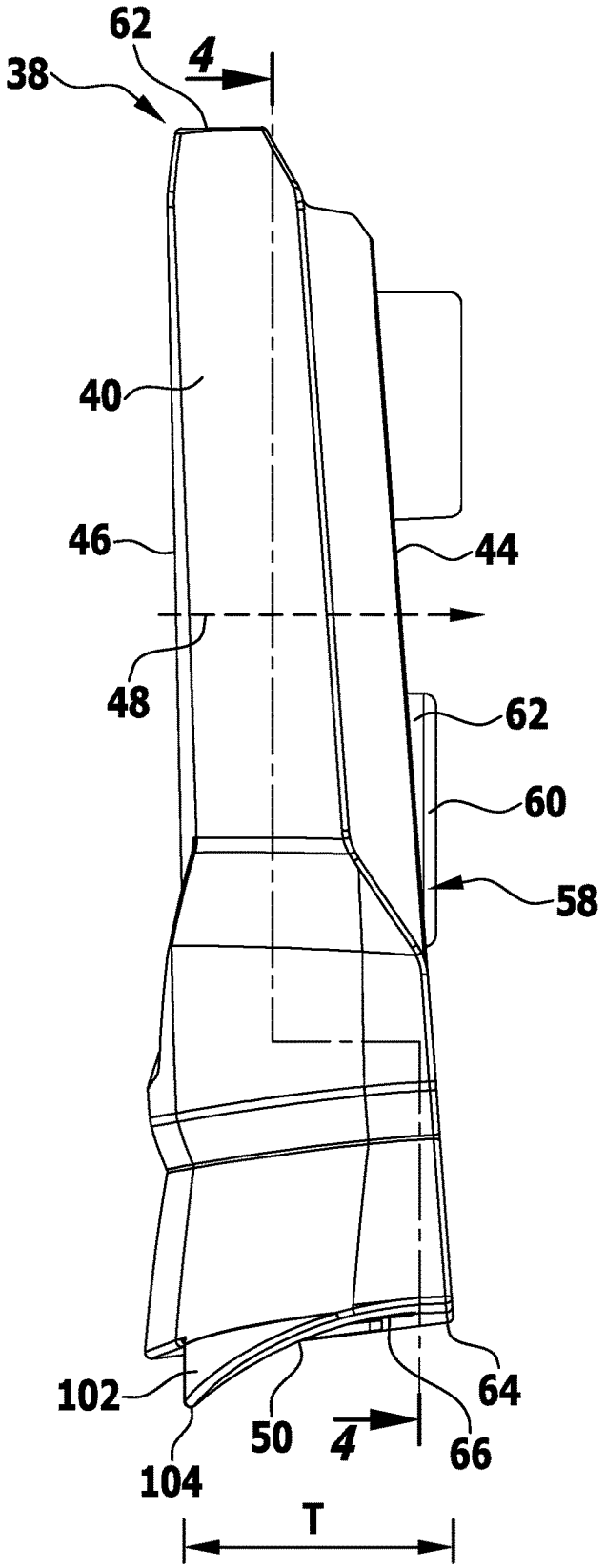
FIG. 3 is a side view of the chamber according to FIG. 2.

The cleaning device 10 has a chamber 38 which provides silencing (noise reduction). The chamber 38 (FIGS. 2 to 4) comprises a wall 40 which surrounds a cavity 42.

The wall 40 has here a first wall 44 and an opposing second wall 46. The first wall 44 and the second wall 46 are spaced apart from one another in a depth direction 48. The chamber 38 has a depth T (FIG. 3) in the depth direction 48.

The first wall 44 and the second wall 46 are connected to one another by side walls for the purpose of closing the cavity 42. These side walls comprise a floor-side wall 50 and a ceiling-side wall 52. The floor-side wall 50 and the ceiling-side wall 52 oppose one another in a height direction. The chamber 38 has a height H which is the spacing between the floor-side wall 50 and the ceiling-side wall 52.

In one embodiment, if the chamber 38 is fixed on the cleaning device 10 and the cleaning device 10 is set up in an operating mode on the support 20, the ceiling-side wall 52 is arranged in relation to the direction of gravity g above the floor-side wall 50.

Laterally, the cavity 42 is closed by a first lateral side wall 54 and by an opposing second lateral side wall 56, both walls being spaced apart. The chamber 38 has a width B perpendicular to the height direction (and perpendicular to the depth direction 48) which is the spacing between the first lateral side wall 54 and the second lateral side wall 56.

In one embodiment, the cavity 42 has an approximately rectangular shape (cf. FIG. 4) in cross section.

In the case of the chamber 38 being positioned on the cleaning device 10, the first wall 44 faces toward the housing interior 36 and the second wall 46 faces toward the exterior space. The second wall 46 forms an outer side of the cleaning device 10 and of the housing 34.

The chamber 38, as a whole, itself forms a unit which is a housing wall and closes up the housing 34, i.e. covers the housing interior 36.

In the embodiment shown in FIG. 1, the chamber 38 forms a rear wall for the housing 34 which is located above the rear wheel device 22 and below a holding region of the handle unit 28.

In principle, it is also possible that the chamber 38 forms, for example, a front wall or side wall for the housing 34.

It is furthermore possible that the chamber 38 forms a wall which has additional functions such as holding functions or support functions for further components of the cleaning device 10.

The chamber 38 comprises an inlet device 58 with an inlet opening 60 for a fluid stream. The inlet opening 60 is fluidically coupled to the air-conduit device 14 and in particular to the exhaust air-conduit device 16.

It is also possible that the inlet opening 60 is, for example, coupled to a cold air discharge.

A fluid stream and in particular an air stream, which can be acted upon by liquid, can be coupled into the cavity 42 via the inlet device 58.

The inlet opening 60 is in particular arranged on the first wall 44. For example, an inlet nozzle 62 is provided on the first wall 44 for coupling in particular to the exhaust air-conduit device 16. A corresponding sealing device is arranged on the inlet nozzle 62.

The chamber 38 furthermore has an outlet device 64, via which a fluid stream can be coupled out of the cavity 42.

In one embodiment, the outlet device 64 comprises one or more outlet openings 66 which are arranged on the floor-side wall 50. A fluid stream and in particular an air stream can be released to an exterior space via the outlet device 64. The outlet opening or outlet openings 66 are located on an outer side of the cleaning device 10 (cf. FIG. 1).

It can be provided here that a porous plate 68 is arranged on the outlet device 64 in order to achieve a reduction in turbulence upon exit.

The chamber 38 is constructed as a chamber silencer which provides silencing. Air, and in particular exhaust air, of a suction current or exhaust air of an air cooler of the cleaning device 10 is released to the exterior space after passing through the chamber 38.

The chamber 38 is fixed here, in particular removably, on the cleaning device 10 and in particular on the base 18. When the chamber 38 is removed, access to the housing interior 36 is possible.

The chamber 38 is constructed in a fluid-tight manner by means of the wall 40, with a defined fluid path between the inlet device 58 and the outlet device 64.

A silencer device 70 is arranged in the cavity 42. Sound waves are reflected within the cavity 42. Reflected sound waves are attenuated within the cavity 42 and the proportion of sound waves which escape through the outlet device 64 into the exterior space is reduced; the total energy of sound waves which escape at the outlet device 64 into the exterior space is lower (and in particular significantly lower) than the total energy of sound waves which enter via the inlet device 58 in the cavity 42.

A partition wall 72 is arranged in the cavity 42 in the chamber 38. In one embodiment, the partition wall 72 is constructed as a self-connected closed structure, around which corresponding fluid streams which enter via the inlet opening 60 flow. The partition wall 72 itself is constructed in a fluid-tight manner, and an interior 74 which is surrounded by the partition wall 72 is not acted upon by fluid (the partition wall 72 can also be constructed in a solid manner such that the interior 74 is in the solid material of the partition wall 72).

The partition wall 72 extends between the first wall 44 and the second wall 46, and is connected to these.

A first fluid channel 76 and a second fluid channel 78 are formed in the cavity by the partition wall 72. Both the first fluid channel 76 and the second fluid channel 78 extend from the inlet opening 60, and both the first fluid channel 76 and the second fluid channel 78 run from this inlet opening 60 to the outlet device 64.

The first fluid channel 76 serves substantially to convey air in the cavity 42 from the inlet opening 60 to the outlet device 64 and to release it into the exterior space.

The second fluid channel 78 serves substantially to isolate and discharge liquid and, in particular, water possibly contained in the fluid which is coupled in via the inlet opening 60.

In one embodiment, the first fluid channel 76, originating from the inlet opening 60, runs upward contrary to the direction of gravity g. The second fluid channel 78 runs downward in the direction of gravity.

The partition wall 72 has an indentation 80 in the region of the inlet opening 60. The indentation 80 defines a recess space 82. The inlet opening 60 is located, at least in part, in the recess space 82.

Originating from the inlet opening 60, the first fluid channel 76 tapers in its hydraulic cross section.

The indentation 80 has in particular a curved wall. A sound mirror is thereby formed at the inlet opening 60. The inlet opening 60 is located between the indentation 80 and the first lateral side wall 54.

In one embodiment, the first lateral side wall 54 is arranged in the region of the inlet opening 60, for example, at an angle to a central axis 84 of the chamber 38. This angle 86 is a small acute angle.

In the case of the chamber 38 being positioned on the cleaning device 10, the central axis 84 is, in particular, parallel to the direction of gravity g.

Figure 4:
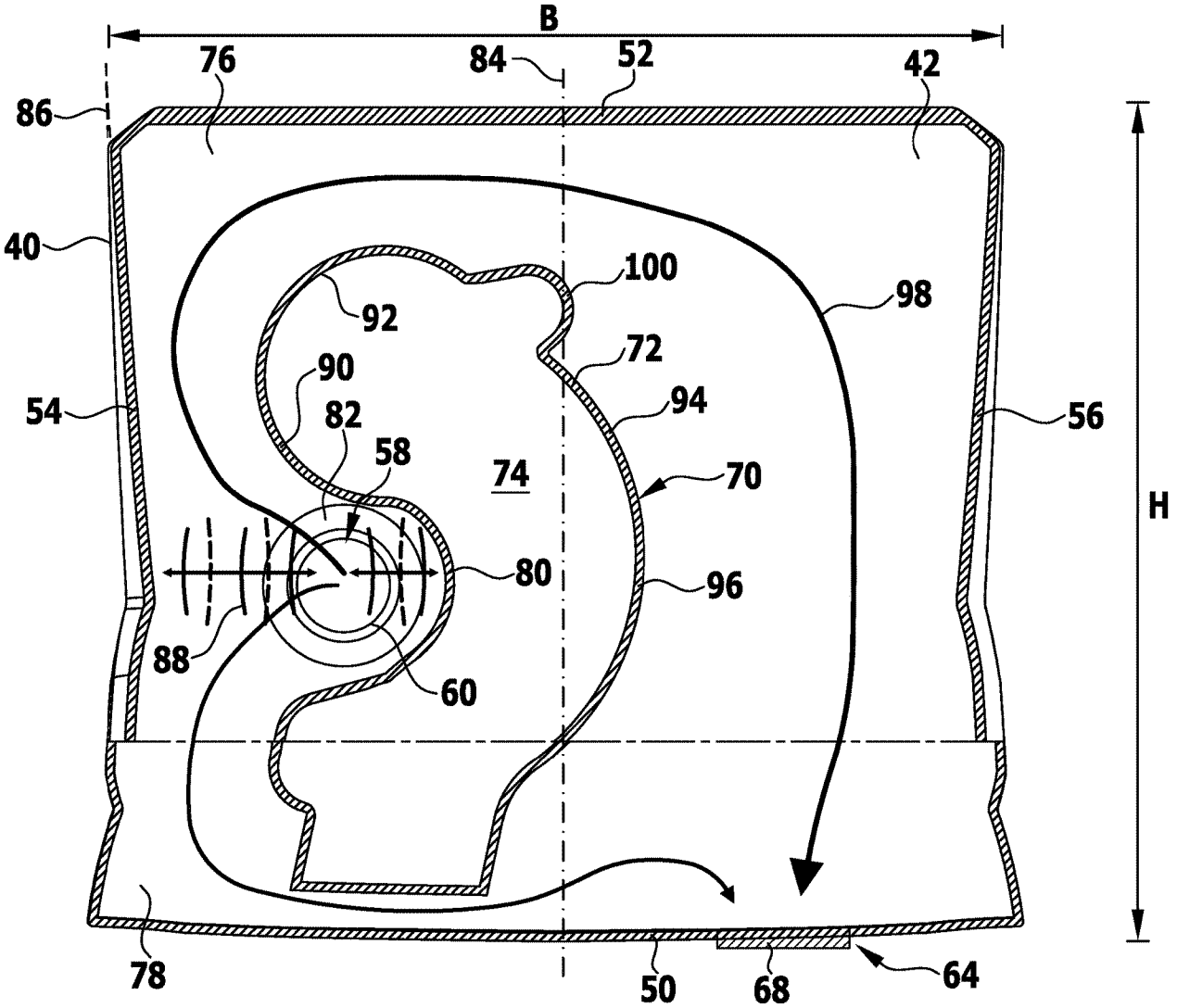
FIG. 4 is a section view along the line 4-4 according to FIG. 3.

Sound waves which enter via the inlet opening 60 or which arise at said opening are reflected on the region of the partition 72 at the indentation 80, and thereby reflected in the direction of the first lateral side wall 54. Furthermore, sound waves are reflected on the first lateral side wall 54. This is indicated in FIG. 4 by the reference numeral 88. Furthermore, sound waves are reflected on the second wall 46.

An attenuation of the corresponding sound waves then occurs on the wall 40 and the partition wall 72. Sound energy is then absorbed within the chamber 38.

The partition wall 72 produces an acoustic shielding (shadowing) effect, i.e. sound waves which enter via the inlet device 58 or arise there are shielded with respect to the outlet device 64, i.e. a proportion of the sound waves does not reach the outlet opening or only reaches it with reduced intensity.

A first region 90 is attached to the indentation 80 of the partition wall 72, in which first region the partition wall 72 is configured such that a tapering of the flow cross section occurs.

A second region 92 is attached to the first region 90, which second region serves to cause a flow deflection by approx. 90°. Originating from the inlet opening 60, fluid with a high air content flows initially upward contrary to the direction of gravity. The flow is diverted by 90°, by the second region 92, to an approximately horizontal direction.

A third region 94 follows the second region 92, which third region ensures a deflection downward in the direction toward the outlet device 64, with a further flow deflection of approx. 90°. A fourth region 96 which faces the second lateral side wall 56 then follows. In this region, the flow in its main direction is toward the direction of gravity and is conveyed to the outlet device 64.

In FIG. 4, a flow line 98 for a corresponding air stream is indicated.

The partition wall 72 is constructed here, in particular, in a curved manner, in order to achieve a flow course with as low a pressure loss as possible.

The partition wall 72 can have a bulge 100. The bulge 100 is arranged in particular on the third region 94 and/or fourth region 96. An additional sound mirror is provided by means of this bulge 100.

As already mentioned above, the second fluid channel 78 substantially provides for the discharge of liquid downward in the direction of gravity g.

One or more channels 102 for removing liquid are arranged in the region of the floor-side wall 50, said channels being fluidically connected to the second fluid channel 78. The channel(s) 102 lead in the direction of a liquid outlet device 104, via which liquid can be coupled out.

The liquid outlet device 104 is located in particular at a lowest point of the chamber 38 in relation to the direction of gravity g.

In one embodiment, the width B is greater than the depth T, and in particular greater by at least five times and for example by at least ten times.

Furthermore, the height H is greater than the depth T, and in particular greater by at least five times and for example by at least ten times.

The first fluid channel 76 defines a passage for a fluid stream in the cavity 42. This passage is, in its hydraulic cross sectional area, at least as large as a hydraulic cross sectional area of the inlet opening 60 or of the hydraulic cross sectional area of the outlet device 64, i.e. no narrowing occurs on the first fluid channel 76 compared with the inlet opening 60.

At the inlet opening 60 itself, a cross-sectional jump occurs by way of the indentation 80 in order to enable an effective sound reflection.

The cleaning device 10 functions as follows.

Exhaust air is coupled in by means of the exhaust air-conduit device 16 via the inlet device 58 and the chamber 38. The exhaust air here can be suction exhaust air or cooling exhaust air.

In principle, it is also possible that, for example, supply air is coupled into the chamber 38.

Suction air can, for example, contain liquid as well.

Fluid flows in the cavity 42, whereby the flow conveyance is set by means of the partition 72.

The silencer device 70 is arranged in the cavity 42, which silencer device ensures an acoustic shielding effect within the chamber 38. This causes a reduction in noise.

The chamber 38 itself has an additional function on the cleaning device. In the shown embodiment, it is itself constructed as a wall which can be removed in order to enable access to the housing interior 36. The chamber 38 forms a rear wall of the housing 34 of the cleaning device 10.

The chamber 38 forms a chamber silencer by means of which an effective sound reduction can be achieved, without, for example, absorber materials and the like having to be provided. The chamber 38 can thus also be used in an advantageous manner in wet conditions such as, for example, in a wet-dry vacuum cleaner or spray extraction device.

A "phase separation" of air stream and liquid can also occur in the chamber 38 by means of the provision of the second fluid channel 78, and liquid can be discharged via the channel(s) 102 (water discharge channel).

Figure 5:
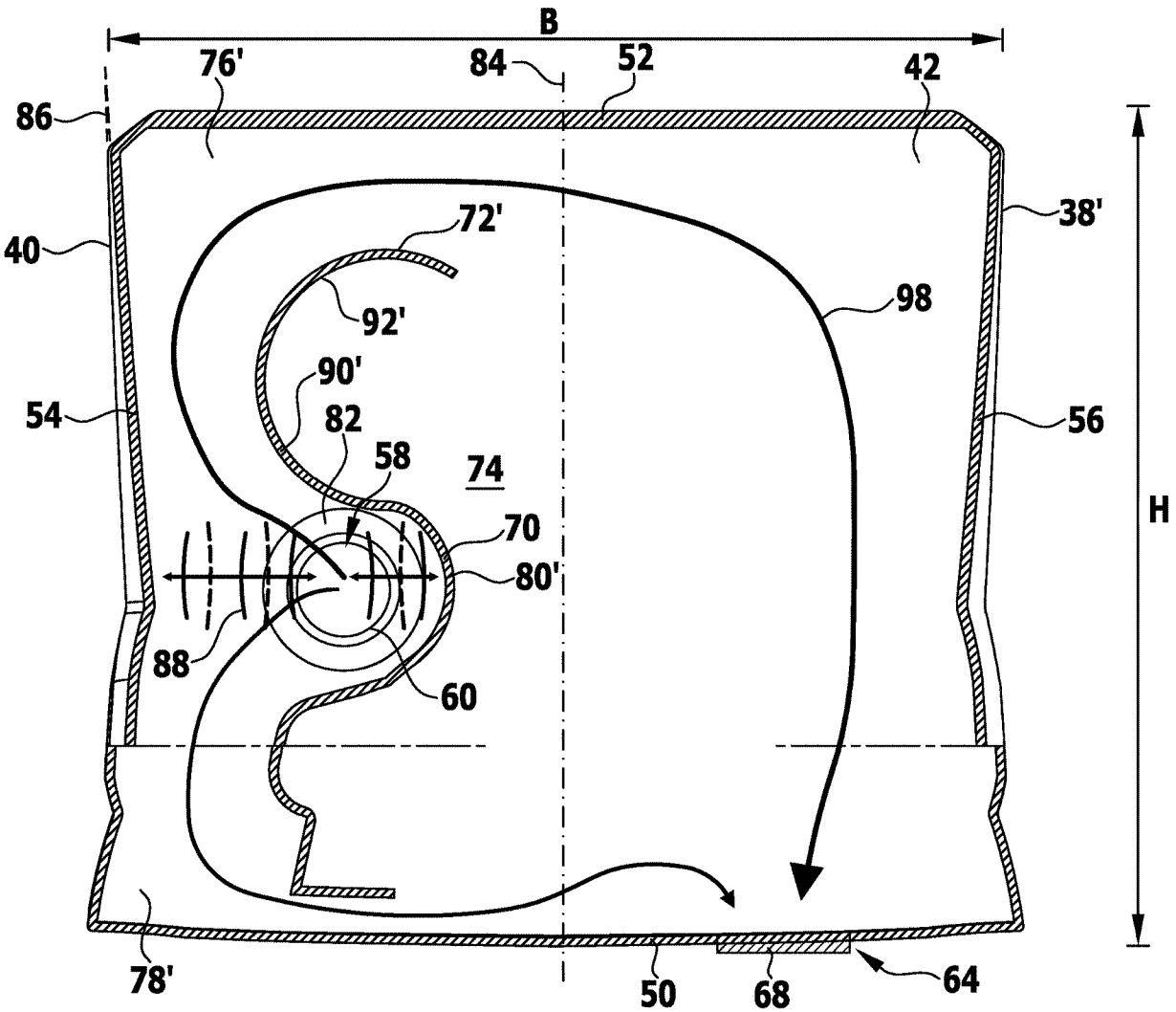
FIG. 5 is a section view similar to that of FIG. 4 for a further embodiment of a chamber.

In a further embodiment of a chamber 38' which is shown in FIG. 5 in a section view similar to the section view according to FIG. 4, a partition 72' is provided which, compared with the partition wall 72 according to FIG. 4, is not closed. The partition wall 72' has, like the partition wall 72, a recess 80', a first region 90' and a second region 92'. A first fluid channel 76' and a second fluid channel 78' are formed.

The partition wall 72' has an at least approximately uniform thickness.

The corresponding chamber 38' functions otherwise like the chamber 38. The same reference numerals are used for the same elements for the chamber 38' according to FIG. 5 as for the chamber 38.

Figure 6:
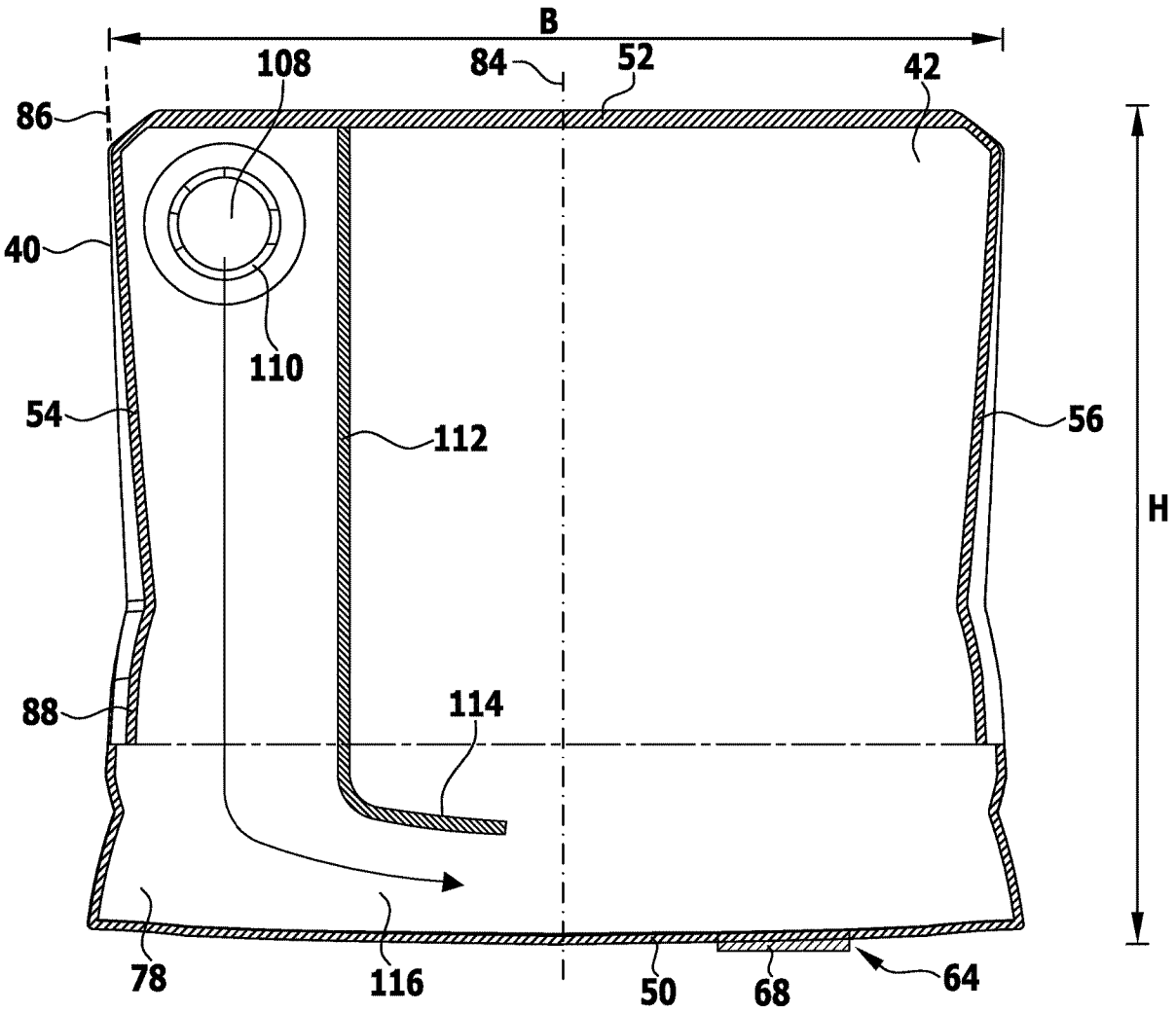
FIG. 6 is a section view similar to that of FIG. 4 for a further embodiment of a chamber.

In a further embodiment of a chamber 106 (FIG. 6), the wall is in principle constructed the same as for the chamber 38, and the same reference numerals are used.

An inlet device 108 is provided which has an inlet opening 110, said inlet opening being located in relation to the direction of gravity g in the region of an upper corner of the wall 40. The inlet opening 110 is located for example in proximity to the first lateral side wall 54 below the ceiling-side wall 52.

A partition wall 112 is located opposite the inlet opening 110. The partition wall 112 extends here between the corresponding first wall 44 and the second wall 46 of the chamber 106. The partition wall 112 runs from the ceiling-side wall 52, for example, at least approximately parallel to the central axis 84 in the direction of the floor-side wall 50, and has a bend 114 at a distance from the floor-side wall 50. A fluid channel 116 is thus formed, which leads to the outlet device 64.

Only a single fluid channel 116 is provided. Starting from the inlet opening 110, fluid can flow downward in relation to the direction of gravity g therein, and flow past the bend 114 to the outlet device 64 at least approximately in a horizontal direction.

The partition wall 112 is constructed such that an acoustic shielding (shadowing) effect is produced.

Sound waves which enter through the inlet opening 110 are reflected on the second wall 46. Furthermore they are reflected on the partition wall 112 in the region of the inlet opening 110 and on the lateral side wall 54.

The shielding effect occurs for sound waves in relation to the wave path between the inlet device 108 and the outlet device 64.

A sound reduction occurs.

Liquid entering via the inlet opening 110 can discharge in the region of the floor-side wall 50. In particular, a corresponding channel is provided which leads to a liquid outlet device.

Otherwise the chamber 106 functions like the chamber 38.

REFERENCE NUMERALS LISTING

10 Cleaning device
11 Fan device
14 Air-conduit device
16 Exhaust air-conduit device
18 Base
20 Support
22 Rear wheel device
24*a* Left rear wheel
24*b* Right rear wheel
26 Front wheel device
28 Handle unit
30 Collecting tank
32 Filter device
34 Housing
36 Housing interior
38, 38' Chamber
40 Wall
42 Cavity
44 First wall
46 Second wall
48 Depth direction
50 Floor-side wall
52 Ceiling-side wall
54 First lateral side wall
56 Second lateral side wall
58 Inlet device
60 Inlet opening
62 Inlet nozzle
64 Outlet device
66 Outlet opening
68 Porous plate
70 Silencer device
72, 72' Partition
74 Interior
76, 76' First fluid channel
78, 78' Second fluid channel
80, 80' Indentation
82 Indentation space
84 Central axis
86 Angle
88 "Reflection"
90, 90' First region
92, 92' Second region
94, 94' Third region
96 Fourth region
98 Flow line
100 Bulge
102 Channel
104 Liquid outlet device
106 Chamber
108 Inlet device
110 Inlet opening
112 Partition
114 Bend
116 Fluid channel

The invention claimed is:

1. A cleaning device comprising:

a base;

an air-conduit device which is arranged on the base; and at least one chamber with a wall which delimits a cavity, an inlet device for a fluid stream and an outlet device being arranged on the wall, and at least one fluid channel running in the cavity between the inlet device and the outlet device;

wherein at least one partition wall is arranged in the cavity, said partition wall producing an acoustic shielding effect between the inlet device and the outlet device; and wherein a liquid outlet device is arranged on the at least one chamber.

2. The cleaning device according to claim 1, wherein the at least one chamber is arranged on the base and forms at least one of (i) a retaining wall for one or more components of the cleaning device, (ii) a housing wall of a housing of the cleaning device, which housing wall delimits a housing interior, and (iii) the base at least in part.

3. The cleaning device according to claim 1, wherein the at least one chamber forms a rear wall or front wall or side wall of a housing of the cleaning device.

4. The cleaning device according to claim 2, wherein a fan device is arranged in a housing interior of the housing.

5. The cleaning device according to claim 1, wherein the at least one chamber is positioned removably on the base, this chamber being fluidically connected to the air-conduction device via the inlet device in the case of at least one chamber being positioned on the base.

6. The cleaning device according to claim 1, wherein the at least one chamber has a depth which is smaller than at least one of a width and a height of the at least one chamber.

7. The cleaning device according to claim 1, wherein the wall comprises a first wall and an opposing second wall which are spaced apart in a depth direction, side walls being arranged between the first wall and the second wall.

8. The cleaning device according to claim 7, wherein the inlet device is arranged on the first wall.

9. The cleaning device according to claim 7, wherein an outer side of the second wall forms an outer side of the cleaning device.

10. The cleaning device according to claim 7, wherein the outlet device is arranged on the second wall or on a side wall.

11. The cleaning device according to claim 1, wherein the outlet device is arranged in relation to the direction of gravity below the inlet device when the cleaning device is set up on a support in an operating mode.

12. The cleaning device according to claim 11, wherein the outlet device is arranged on a floor-side wall which, of the side walls of the at least one chamber, is nearest to the support.

13. The cleaning device according to claim 1, wherein the at least one chamber is an independent unit which is fixable or is fixed as a whole on the base.

14. The cleaning device according to claim 1, wherein at least a first fluid channel and a second fluid channel are provided, which run from an inlet opening of the inlet device.

15. The cleaning device according to claim 14, wherein the first fluid channel and the second fluid channel at the inlet opening lead away from one another.

16. The cleaning device according to claim 14, wherein the second fluid channel leads downward in relation to the direction of gravity when the cleaning device is set up in an operating mode on a support.

17. The cleaning device according to claim 16, wherein the second fluid channel is delimited by a floor-side wall of the at least one chamber.

18. The cleaning device according to claim 14, wherein the first fluid channel is led away from the inlet opening upward in relation to the direction of gravity.

19. The cleaning device according to claim 14, wherein the first fluid channel is delimited by a ceiling-side wall of the at least one chamber.

20. The cleaning device according to claim 1, wherein at least one channel for discharging liquid is associated with the at least one chamber.

21. The cleaning device according to claim 1, wherein the at least one partition wall forms a wall of the at least one fluid channel.

22. The cleaning device according to claim 21, wherein the partition wall has a self-connected closed course.

23. The cleaning device according to claim 21, wherein an inlet opening of the inlet device is arranged between the partition wall and a side wall of the at least one chamber.

24. The cleaning device according to claim 21, wherein the at least one partition wall has an indentation, an inlet opening of the inlet device being arranged at least in part in an indentation space delimited by the indentation.

25. The cleaning device according to claim 24, wherein, starting from the inlet opening, in a first region a fluid channel has a hydraulic channel cross section which narrows, in a second region the fluid channel causes a flow deflection of at least approximately 90°, and in a third region the fluid channel causes a further flow deflection of at least approximately 90°.

26. The cleaning device according to claim 25, wherein the partition has a curved course in at least one of (i) the first region, (ii) the second region, (iii) the third region, (iv) at a transition between the first region and the second region, and (v) at a transition between the second region and the third region.

27. The cleaning device according to claim 1, wherein the inlet device is coupled to at least one of an exhaust air-conduit device of a fan device and a cold air-conduit device.

28. The cleaning device according to claim 1, wherein the outlet device is arranged on an outer side of the cleaning device.

29. The cleaning device according to claim 1, wherein a porous device for reducing turbulence is arranged on the outlet device.

30. The cleaning device according to claim 1, said cleaning device being configured as a spray extraction device or suction device.

31. A cleaning device comprising:

a base;

an air-conduit device which is arranged on the base; and at least one chamber with a wall which delimits a cavity, an inlet device for a fluid stream and an outlet device being arranged on the wall, and at least one fluid channel running in the cavity between the inlet device and the outlet device;

wherein at least one partition wall is arranged in the cavity, said partition wall producing an acoustic shielding effect between the inlet device and the outlet device; and wherein the outlet device is arranged in relation to the direction of gravity below the inlet device when the cleaning device is set up on a support in an operating mode.

32. A cleaning device comprising:

a base;

an air-conduit device which is arranged on the base; and at least one chamber with a wall which delimits a cavity, an inlet device for a fluid stream and an outlet device being arranged on the wall, and at least one fluid channel running in the cavity between the inlet device and the outlet device;

wherein at least one partition wall is arranged in the cavity, said partition wall producing an acoustic shielding effect between the inlet device and the outlet device;

wherein at least a first fluid channel and a second fluid channel are provided, which run from an inlet opening of the inlet device; and wherein the second fluid channel leads downward in relation to the direction of gravity when the cleaning device is set up in an operating mode on a support.

33. A cleaning device comprising:

a base;

an air-conduit device which is arranged on the base; and at least one chamber with a wall which delimits a cavity, an inlet device for a fluid stream and an outlet device being arranged on the wall, and at least one fluid channel running in the cavity between the inlet device and the outlet device;

wherein at least one partition wall is arranged in the cavity, said partition wall producing an acoustic shielding effect between the inlet device and the outlet device; and wherein at least one channel for discharging liquid is associated with the at least one chamber.

* * * * *